United States Patent [19]

Robinson et al.

[11] 4,291,623

[45] Sep. 29, 1981

[54] BINARY ELECTROEXPLOSIVE DEVICE AND METHOD OF ASSEMBLY THEREOF

[75] Inventors: Ralph L. Robinson, Kingwood; David D. Parrish, Spring, both of Tex.

[73] Assignee: NL Industries, Inc., New York, N.Y.

[21] Appl. No.: 974,505

[22] Filed: Dec. 29, 1978

[51] Int. Cl.[3] ..... E21B 43/263; F42C 19/12

[52] U.S. Cl. ..... 102/310; 102/202.6; 102/202.9; 102/206; 86/22

[58] Field of Search ..... 102/20, 21.6, 28 P, 102/29, 203

[56] References Cited

U.S. PATENT DOCUMENTS

| | | | |
|---|---|---|---|
| 1,599,078 | 9/1926 | Corrie | 102/29 |
| 1,901,469 | 3/1933 | Piccard | 102/29 |
| 2,677,803 | 5/1954 | Rork | 102/203 X |
| 2,680,406 | 6/1954 | Austin | 102/20 |
| 2,767,655 | 10/1956 | Seavey | 102/29 X |
| 2,891,477 | 6/1959 | Swanson | 102/20 X |
| 2,918,871 | 12/1959 | Taylor | 102/203 |
| 3,585,933 | 6/1971 | Kos | 102/28 |
| 3,739,723 | 6/1973 | Hakala | 102/20 |
| 4,011,815 | 3/1977 | Garcia | 89/1 C X |
| 4,172,421 | 10/1979 | Regalbuto | 102/20 |

FOREIGN PATENT DOCUMENTS

| | | |
|---|---|---|
| 927705 | 6/1963 | United Kingdom . |
| 1031357 | 6/1966 | United Kingdom . |
| 1072784 | 6/1967 | United Kingdom . |
| 1292924 | 10/1972 | United Kingdom . |
| 2025711 | 1/1980 | United Kingdom . |

*Primary Examiner*—Richard D. Lovering

*Attorney, Agent, or Firm*—Browning, Bushman & Zamecki

[57] ABSTRACT

Disclosed is a binary electroexplosive device including an explosive lead and a pyrotechnic explosive which may be selectively positioned to initiate the explosive lead upon combustion of the pyrotechnic material. The pyrotechnic material is contained in an initiator assembly which may be inserted within a combination socket and housing which also holds the explosive lead facing the pyrotechnic material but spaced therefrom. Insertion of the initiator assembly within the socket completes electrical connections between a power source and a bridgewire within the initiator assembly embedded in the pyrotechnic material. In a particular embodiment shown, the electroexplosive device is utilized as a blasting cap for a well jet perforating gun wherein the gun may be completely assembled with the exception of the insertion of the initiator assembly in the socket. At the well site, the electrical system may be tested for shorts or other malfunctions by a combination test and insertion tool, whereby the initiator assembly may then be seated to arm the electroexplosive device.

39 Claims, 8 Drawing Figures

FIG. 3
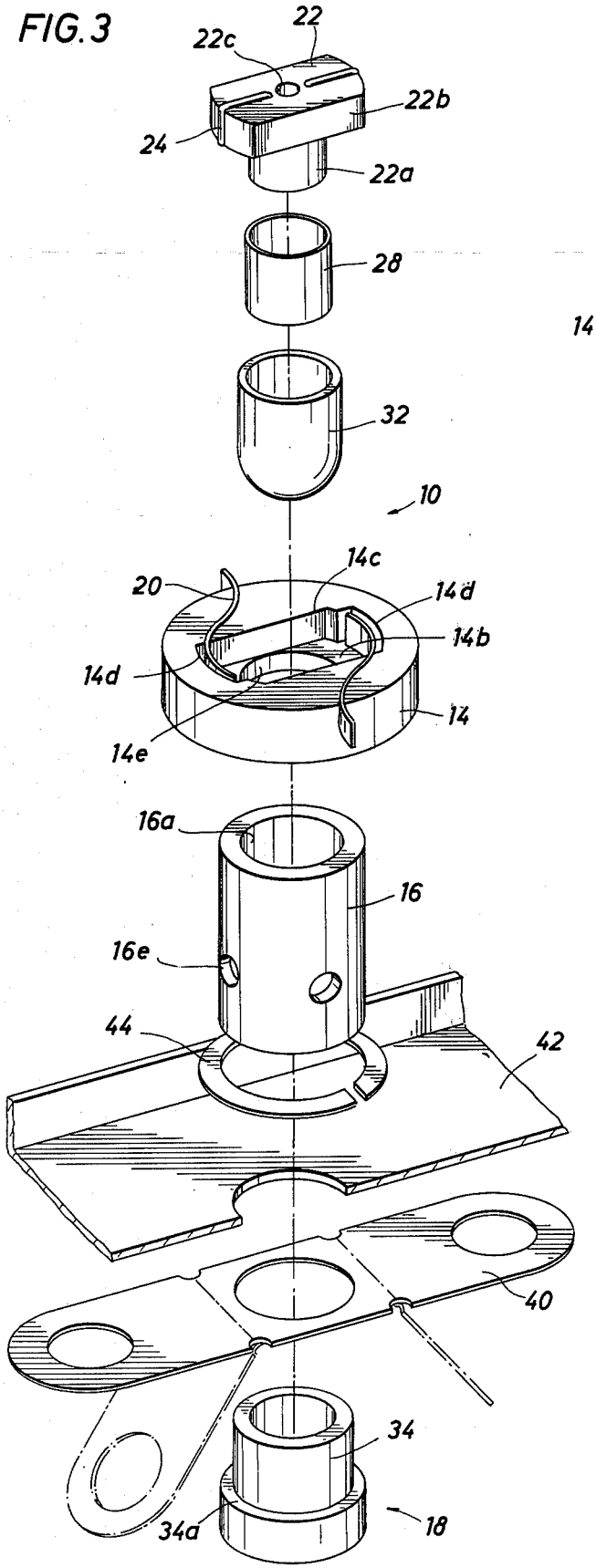
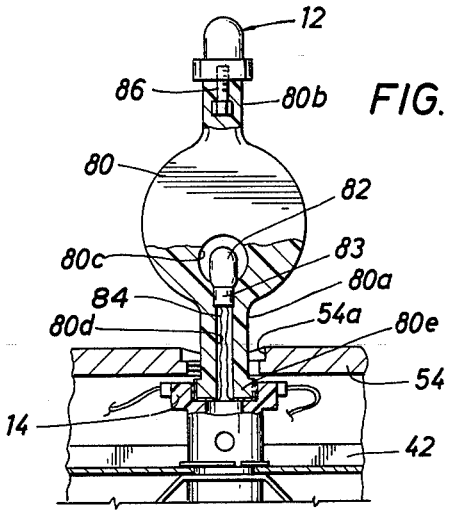
FIG. 6
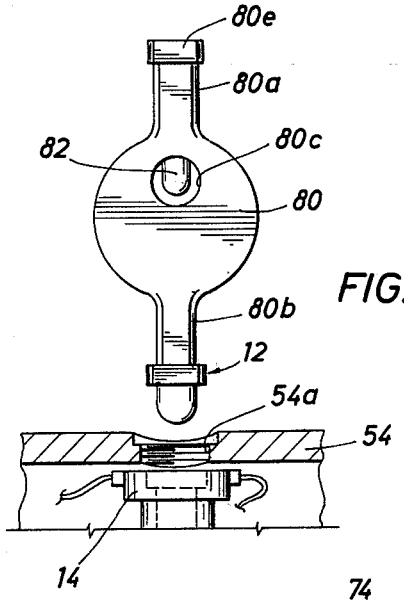
FIG. 7
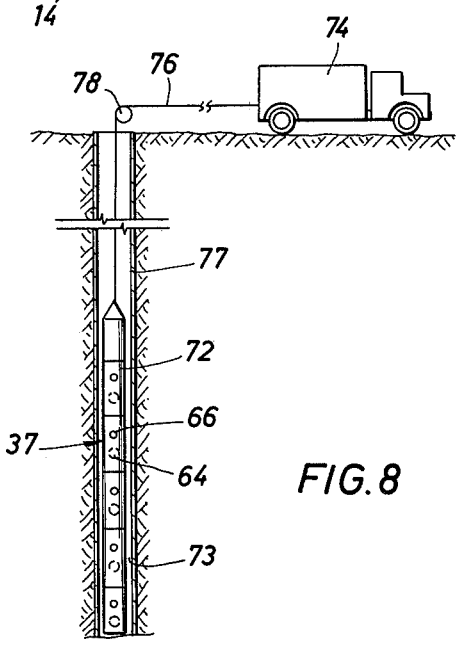
FIG. 8

BINARY ELECTROEXPLOSIVE DEVICE AND METHOD OF ASSEMBLY THEREOF

BACKGROUND OF THE INVENTION

1. Field of the Invention

The present invention pertains to explosive devices such as blasting caps. More particularly, the present invention is related to techniques for initiating the detonation of an explosive train by electroexplosive devices, and finds particular application in the field of jet guns used to perforate casing in walls such as oil and gas wells.

2. Description of Prior Art

It is well known to line wells, particularly oil and gas wells, with casing cemented in place to prevent the unwanted intrusion of fluids and debris into the well. In a typical operation, a well is cased in sections as the well is being drilled to the desired depth. Such as well may traverse one or more formations containing fluid which is sought to be produced by the well. However, once the well is lined with cemented casing, the desirable formations as well as the remainder of the underground structure are sealed off from the well. A tool containing one or more perforating guns is lowered by a cable to position a perforating gun at the level of a formation from which fluid is to be produced. The perforating gun is then fired by an electrical signal controlled at the surface. In practice, more than one such gun may be fired in response to the same electrical signal to produce multiple perforations in the casing at the same formation. Also, with a multiple gun tool, the individual guns may be selectively fired to produce perforations at various levels in the well as the tool is selectively positioned at the various formations.

Within the jet perforating gun, the shaped charge which provides the jet which produces the actual perforation is at the end of an explosive train which begins with a blasting cap in the form of an electroexplosive fuse. Firing of the fuse by an electrical signal detonates a booster which in turn detonates the explosive material of the shaped charge.

Current United States Government Regulations prohibit the transport of charged perforating guns over highways with the blasting caps installed in the guns. Consequently, it is the current general practice to only partially assemble the perforating gun prior to transport of same to the well site. There, the explosive train is made up and the perforating gun is completely assembled for use in the well. However, to make up the explosive train at the well site, it is necessary to handle the explosive devices themselves as well as to complete the electrical connections between the blasting cap and the electrical system which provides the firing signal. This is an inherently dangerous operation and may be required to be performed under less than ideal conditions, particularly where the well site is exposed to extreme weather or other deleterious conditions.

U.S. Pat. No. 148,338 issued to Varney discloses an early type electroexplosive blasting cap. U.S. Pat. No. 4,011,815 issued to Garcia discloses an explosive train arrangement within a perforating gun whereby an electrically-actuated detonator may be moved between two positions. In one such position, the detonator is sufficiently close to a receptor explosive wherein the explosive train is armed. Thus, in such configuration, firing of the detonator would cause detonation of the receptor explosive as well. In the other position, the detonator is sufficiently removed from the receptor explosive to prevent detonation of the latter upon firing of the detonator. An external indicator is provided whereby an operator may visually determine whether a detonator within the perforating gun is in the unarmed configuration. The latter patent also discloses an arrangement whereby a barrier may be selectively positioned between the detonator and the receptor explosive, the presence or absence of the barrier again being indicated externally for observation by an operator.

Inspite of the placing of the apparatus described in the '815 patent in a "disarmed" configuration, it appears that the transport of such an otherwise completely assembled perforating gun on the public highways is still precluded by current government regulations.

It is thus desirable to provide an explosive train assembly wherein an otherwise assembled perforating gun may be considered disarmed and in condition for transport on the highways in compliance with government regulations, while at the same time not requiring extensive assembly at the well site.

SUMMARY OF THE INVENTION

Electroexplosive apparatus according to the present invention includes first and second explosives which may be mutually positioned in the apparatus so that ignition of the first explosive material effects initiation of the second explosive material.

The second explosive material is held in a plug or like structure which is mounted toward one end of a housing. Together the plug and the second explosive material are included in a receptor assembly.

The opposite end of the housing is fitted with a socket featuring a pair of electrical conductors. The first explosive material is included in an initiator assembly which features a plug receivable by the socket. With the initiator plug seated in the socket, the first explosive material is positioned to initiate the second explosive material upon combustion of the first explosive.

The initiator plug also includes a pair of electrical leads positioned so that each such lead makes electrical contact with a separate one of the electrical conductors of the socket when the initiator assembly is seated therein. The ends of the initiator plug leads are joined by a bridgewire of high electrical resistance in intimate contact with the first explosive material. Application of electrical power to the socket conductors causes current flow through the initiator plug leads and the bridgewire. The resulting rise in temperature experienced by the bridgewire due to the current flow when sufficient electrical power is so applied ignites the first explosive material. This explosive material, which is pyrotechnic in nature, burns and thus initiates the nearby second explosive material.

The second explosive material may serve to initiate a subsequent explosive. Thus, the receptor assembly also functions as a donor assembly.

The binary electroexplosive device of the present invention finds particular application as a binary primer, or blasting cap, for the explosive train of a jet perforating gun. The entire binary device may be assembled and mounted on a charge holder strip along with the shaped charge of the gun. A fuse or other extended explosive element may be used as a booster to connect the second explosive material in the donor assembly with the explosive of the shaped charge. Application of sufficient electrical power to the socket conductors to ignite the pyrotechnic first explosive triggers the explosion of the receptor/donor assembly second explosive, the extended explosive element and, ultimately, the shaped charge.

Absence of the initiator assembly from the socket not only prevents closure of the electrical circuit to allow the firing of the binary electroexplosive device, but also removes the first explosive material from the vicinity of the second explosive material. Thus, without the initiator assembly seated in the socket, the receptor/donor assembly cannot be initiated.

A jet perforating gun utilizing the binary primer of the present invention may be completely assembled with the exception that the initiator assembly is left out. In such condition, the gun may be transported by highway within current government regulations. At the well site, a plug in an access port in the housing of the perforating gun may be removed to allow insertion of the initiator assembly through the port and into the socket to arm the binary primer. With the access port again plugged, the gun is ready for use.

An installation tool is provided to which the initiator assembly is engaged. Manipulation of the initiator assembly into the socket within the gun is thus facilitated, whereupon the installation tool is disengaged and withdrawn.

A test tool is also provided for ascertaining the condition of the electrical system at the socket conductors prior to insertion of the initiator assembly. The test tool includes an electrically-responsive indicator, such as a light bulb, which is electrically connected across the socket conductors as an arm, or probe, of the test tool is positioned within the socket in place of the initiator assembly. The indicator is chosen to respond to the same current/voltage conditions which form the threshold for firing the initiator assembly first explosive. Consequently, the presence of any short or other defect in the electrical system that might fire the first explosive upon insertion of the initiator assembly may be detected without inserting the initiator assembly.

The present invention provides a binary electroexplosive that may be selectively and completely disarmed. Further, the arming of the device may be effected by simply plugging the initiator assembly into the socket, and without the need for otherwise completing electrical connections or handling additional explosives. The arming of the device in this manner not only places the bridgewire of the initiator assembly in the electrical firing circuit, but also positions the first explosive material in position to initiate the second explosive material upon combustion of the first explosive.

BRIEF DESCRIPTION OF THE DRAWINGS

FIG. 3 is an exploded view, in perspective, of the binary explosive device and strip of FIG. 1;

FIG. 6 is a fragmentary horizontal elevation, in partial section, of a combination test and installation tool in configuration for testing the electrical firing system of the perforating gun;

FIG. 7 is a view similar to FIG. 6 but showing the test and installation tool in configuration for installing the initiator assembly of the binary electroexplosive device; and FIG. 8 is a horizontal elevation in partial section illustrating the suspension of a jet perforating gun tool in a well and the cable connection of the tool to a winch and control truck.

DESCRIPTION OF PREFERRED EMBODIMENTS

Figure 1:
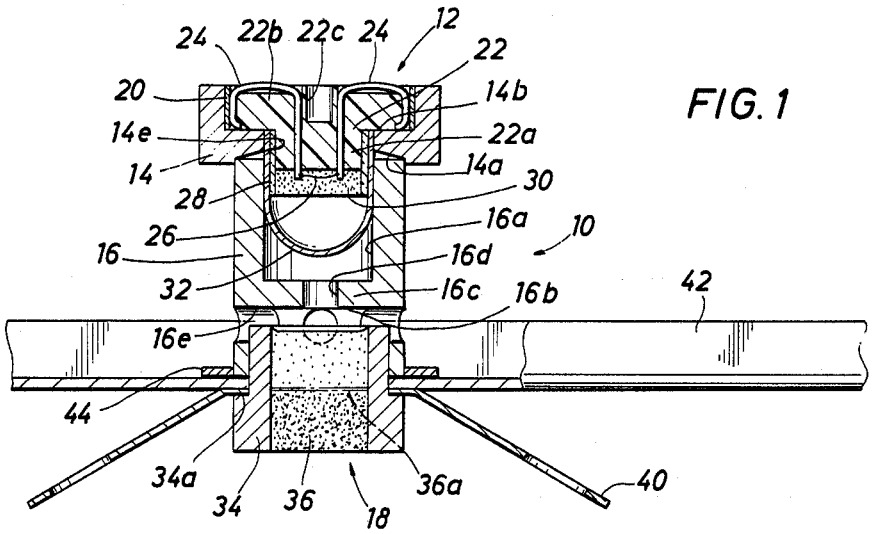
FIG. 1 is a horizontal elevation in cross section of a binary electroexplosive device according to the present invention, mounted on a charge holder strip shown in fragment and cut away.
Figure 2:
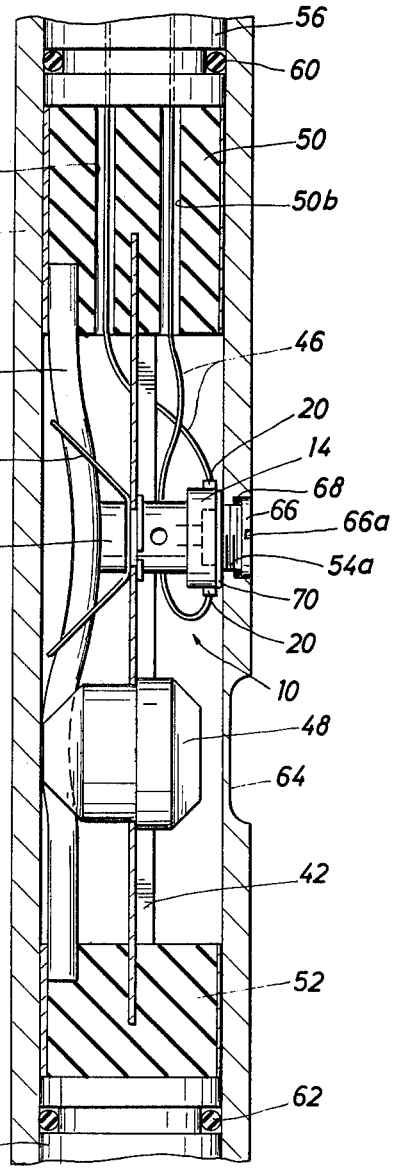
FIG. 2 is a partial horizontal elevation in partial section of a well jet perforating gun utilizing the binary electroexplosive device of FIG. 1.
Figure 4:
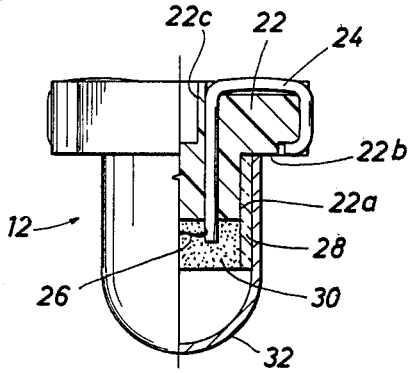
FIG. 4 is a horizontal elevation in quarter section of the initiator assembly of the binary electroexplosive device.

A binary electroexplosive device according to the present invention is shown generally at 10 in FIGS. 1–3 as the device would be mounted on a charge holder strip. An initiator assembly, or squib, shown generally at 12 in FIGS. 1 and 4 is received by the combination of a socket 14 and a housing 16. The socket 14 is mounted at one end of the housing 16, and the initiator assembly 12 extends through the socket and into the housing. A receptor assembly shown generally at 18 is mounted at the opposite end of the housing 16.

The housing 16 is generally tubular, and defines first and second open-ended chambers **16*a* and 16*b*, respectively, separated by a transverse interior wall 16*c*. The interior wall 16*c* features a throughbore 16*d* which communicates between the chambers 16*a* and 16*b*. The transverse dimension of the first chamber 16*a* is such that the interior annular surface of the housing 16 partly defining that chamber may provide frictional contact with the initiator assembly at 12. Similarly, the transverse dimension of the second chamber 16*b* is such that the interior annular surface of the housing 16 partly defining that chamber provides frictional contact with the receptor assembly 18** inserted therein.

Four holes **16*e* through the wall of the housing 16 communicate between the exterior of the housing and the second chamber 16*b*, generally toward the interior wall 16*c*. The function of the holes 16*e*** is discussed hereinafter.

Figure 5:
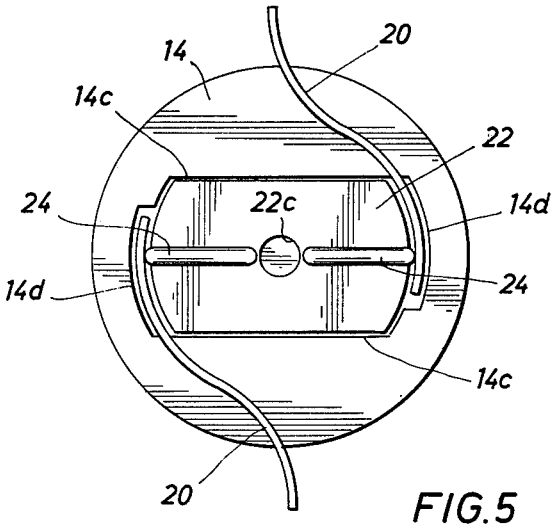
FIG. 5 is a plan view of the initiator assembly positioned within the socket of the binary electroexplosive device.

Details of construction of the socket 14 may be appreciated by reference to FIGS. 1, 3 and 5. The bottom of the socket 14 features a relatively shallow depression **14*a* of circular transverse cross section (FIG. 1). The depression 14*a* encloses the upper end of the housing 16, whereby the socket 14 is positioned about the top of the housing with possible friction contact therebetween. The socket 14 may be bonded to the housing 16 to provide permanent engagement therebetween, and to insure that the socket is held fixed against rotational movement relative to the housing. The socket 14** and the housing may also be manufactured from one piece of stock as a single unit.

A hole **14*b* is provided in the top of the socket 14. The hole 14*b* is generally oblong, being defined in part by a pair of straight, mutually parallel side walls 14*c* and generally arcuate end walls 14*d*. A pair of metallic S-curved strips 20 serving as electrical conductors are received in correspondingly-shaped grooves cut in the top of the socket 14, the metallic strips extending into the hole 14*b* as well as beyond the transverse exterior limits of the socket. Within the hole 14*b*, the metallic strips 20 are curved to generally follow the arcuate shape of the corresponding end walls 14*d*, but are displaced a short distance therefrom. Consequently, there exists room for the metallic strips 20 to be bent slightly toward the corresponding end walls 14***d*, in a manner described hereinafter. The strips 20 may also be bonded to the socket 14 to insure that the strips are held firmly in the grooves.

A passage 14*e* extends through the remainder of the socket 14 between the depression 14*a* and the hole 14*b*. The passage 14*e* is of the same transverse cross section as the chamber 16*a*, as best observed in FIG. 1. Also, as seen in FIG. 3, the transverse distance between the side walls 14*c* of the hole 14*b* is at least as large as the transverse diameter of the passage 14*e*.

The initiator assembly at 12 includes a plug 22 featuring a generally cylindrical shaft 22*a* and an oblong cap or cross piece 22*b*. The lateral periphery of the cap 22*b* takes the general shape of the hole 14*b* of the socket 14. Thus, the cap 22*b* is defined, in part, by two mutually parallel straight side walls and two arcuate end walls such that the cap may fit within the confines of the socket hole 14*b*, and be prevented thereby from being rotated relative to the socket 14.

A pair of wires 24 serving as electrical lead lines pass through holes in the plug 22, and extend beyond the longitudinal limit of the shaft 22*a*. The opposite ends of the wires protruding through the top of the cap 22*b* pass through appropriate grooves along the top of the cap and down the opposite arcuate ends thereof. These ends of the wires 24 then curve into the cap 22*b*, again residing in appropriate grooves formed in the cap.

As may be seen by reference to FIGS. 1, 3 and 5, the wires 24 extend beyond the limits of the arcuate ends of the cap 22*b*. Thus, as indicated in FIGS. 1 and 5, with the plug positioned within the socket 12, the wires 24 contact the extensions of the metallic strips 20 within the socket hole 14*b*. Good electrical contact between the metallic strips 20 and the corresponding wires 24 may be assured by providing a tight fit therebetween. For this purpose, the metallic strips 20 may be positioned within the socket hole 14*b* such that insertion of the plug 22 within the socket 14 results in the wires 24 slightly bending the corresponding metallic strips radially outwardly relative to the longitudinal axis of the socket as contact is made between the wires and the strips. To this end, sufficient room is provided within the socket hole 14*b* at the arcuate ends 14*d* thereof to allow such movement of the metallic strips 20.

The ends of the wires 24 extending beyond the shaft 22*a* are connected by a bridgewire 26, as seen in FIGS. 1 and 4. The bridgewire 26 may be attached to the wires 24 in any conventional manner to provide good electrical contact and mechanical bonding, such as by spot welding or soldering.

A sleeve 28 circumscribes the plug shaft 22*a* and extends beyond the longitudinal limit of the shaft even farther than does the pair of wires 24. Thus, the combination of the sleeve 28 and the lower face of the plug shaft 22*a* defines an inverted cup which may be packed with pyrotechnic explosive material 30. With the pyrotechnic material 30 filling the cup thus defined to the end of the sleeve 28, the bridgewire 26 is completely enclosed in the pyrotechnic material.

A cap 32 circumscribes the sleeve 28 and encloses the pyrotechnic material 30 as a protective device. As is evident from FIG. 1, the transverse dimensions of the socket passage 14*e* and the first housing chamber 16*a* are such that the protective cap 32 may pass through the socket and the housing, but may be held in place by friction due to the contact between the cap and the adjacent surfaces of the socket and housing.

The receptor assembly 18 includes a tubular plug 34 with an annular, radially outwardly extending flange or shoulder 34*a*. The shank of the plug 34 is received within the second housing chamber 16*b* and held there by frictional contact with the interior annular wall partly defining the chamber. The receptor assembly 18 also includes a high order explosive material 36 packed within the plug 34. Thus, the explosive lead 36 is exposed toward both ends of the plug 34.

The socket 14 and the initiator plug 22 are constructed of electrically insulating materials such as plastic. The initiator wires 24 and the socket strips 20 are metallic to function as good electrical conductors. Otherwise, the sleeve 28, the initiator plug 22, the socket 14, the housing 16 and the receptor plug 34 may be constructed of any material that will not react chemically with the two explosive materials 30 and 36.

The bridgewire 26 is a high electrical resistance wire segment, exhibiting a large temperature rise when exposed to a moderate electric current. Fine platinum wire may be used as the bridgewire, for example.

The cap 32 must be constructed of material which will either burn or disintegrate under the influence of combustion of the pyrotechnic material 30. A gelatin capsule half of the type commonly used to package powdered drugs for human consumption may be used as the cap 32. Also, the cap 32 may be constructed of brass, for example.

The pyrotechnic material 30 itself may be any appropriate metal-oxidant combination. The high order explosive material 36 of the receptor assembly 18 may be any appropriate explosive lead. For example, a two-layer combination of lead azide and hexanitrostilbene, mutually separated by a safety partition placed transversely across the interior of the receptor assembly plug 34, may be used with the lead azide facing the initiator assembly 12. Such a partition is indicated in phantom at 36*a* in FIG. 1 separating two components of explosive 36.

In practice the electroexplosive device 10 may be assembled to the extent that the socket 14 and donor assembly 18 are mounted on the housing 16 as shown in FIG. 1, but with the initiator assembly at 12 not yet positioned within the socket or housing. In such case, the device is not armed, and the receptor explosive 36 is not subject to initiation by combustion of the initiator explosive 30. It is only when the initiator assembly 12 is seated within the socket 14 as shown in FIGS. 1 and 5 that the pyrotechnic explosive 30 is in position to allow initiation of the receptor explosive 36, and that the bridgewire 26 is electrically connected to the socket strips 20 whereby electric power may be applied to fire the pyrotechnic explosive, as discussed more fully hereinafter.

The bottom of the receptor assembly 18 may be positioned adjacent an explosive element acting as an acceptor. The receptor explosive 36 then serves to initiate the adjacent explosive element, and functions as a donor. In such case, the receptor assembly 18 is also a donor assembly.

In FIG. 2 the binary explosive device 10 is shown employed as a blasting cap, or primer, in a wall jet perforating gun shown generally at 37. The receptor/-donor assembly 18 is adjacent an elongate explosive element 38 to be detonated by the binary blasting cap 10. A segment of the commonly known explosive sold under the trademark PRIMACORD may be used as the explosive element 38. PRIMACORD includes a powdered explosive confined in a flexible plastic jacket.

The PRIMACORD 38 is held against the exposed receptor/donor explosive 36 by a cord spring 40. The cord spring 40 is shown in FIG. 3 as it might be cut, or stamped, from flat metallic stock. Three holes are provided in the spring 40 as shown, and the two outer portions of the spring are bent downwardly to form a bracket. The formation of the bracket by bending of the cord spring 40 is indicated in phantom in FIG. 3, and is also shown in FIGS. 1 and 2.

The shank of the plug 34 passes through the center hole of the spring 40 as well as a hole provided in a charge strip holder 42. Thus, with the receptor/donor assembly plug 34 held by friction within the second housing chamber 16*b*, the cord spring 40 and the charge strip holder 42 are sandwiched between the plug shoulder 34*a* and the bottom face of the housing 16. In this way, both the electroexplosive device 10 and the cord spring 40 are held in position, mounted on the charge holder strip 42.

With the cord spring 40 mounted as shown in FIG. 1, the PRIMACORD 38 is passed through the two outer holes of the spring, and positioned against the exposed high order explosive material 36. The PRIMACORD is then in position to be detonated by the binary explosive device 10.

For purposes of stability, a retainer ring 44 is positioned to fit tightly around the exterior of the housing 16 against the surface of the charge holder strip 42. The retainer ring 44, which may be in the form of a snap ring as shown, insures that the electroexplosive device 10 will not tilt or wobble relative to the charge holder strip 42 as the combination is handled or transported.

A source of electric power (not shown) is connected by electrical lead lines 46 (FIG. 2) to the ends of the metallic strips 20 extending beyond the external limits of the socket 14. The lead lines 46 may be soldered to the strips 20, which thus act as electric terminals. The power source must be capable of providing sufficient current to heat the bridgewire 26 of the initiator assembly at 12 to thereby cause combustion of the pyrotechnic material 30. In a typical application, the bridgewire may heat sufficiently to fire the pyrotechnic material 30 with a current of 0.5 ampere at 6 volts applied to the socket terminals 20.

Insertion of the initiator assembly at 12 within the socket 14 and the housing 16 as shown in FIG. 1 completes electrical contact between each of the lead lines 46 through the metallic strips 20, the wires 24, and the bridgewire 26. Then, selective closing of the electrical circuit with the power source provides the current to heat the bridgewire to ignite the pyrotechnic material 30.

The charge holder strip 42 is in a conventional form featuring upturned edges for structural rigidity (FIGS. 1 and 3), and not only holds the electroexplosive device 10 but also supports a shaped charge 48 which is positioned within another hole in the strip. The ends of the charge carrier strip 42 are embedded in rubber locators 50 and 52. The PRIMACORD 38 also extends into appropriate holes in the two locators 50 and 52 which thus serve to position the charge holder strip 42 as well as the PRIMACORD within a housing 54 of the gun 37.

The PRIMACORD 38 extends under the shaped charge 48 wherein the PRIMACORD is adjacent to the exposed explosive of the shaped charge. Such an arrangement of explosive elements is well known, particularly in the field of well perforating guns, and will not be described in further detail herein.

The combination of the spring bracket 40, the locators 50 and 52 anchoring the ends of the PRIMACORD booster 38, and the shaped charge 48 under which the PRIMACORD passes causes a bend in the PRIMACORD that effectively holds the PRIMACORD against the plug 34 and the explosive 36.

Beyond the locators 50 and 52 may be additional equipment necessary for the operation of the perforating gun. Such equipment is well known, and only the positions of such are indicated herein as 56 and 58. O-ring seals 60 and 62 provide fluid-tight seals to protect the equipment at 56 and 58 against fluid penetration upon the detonation of the shaped charge 48. The electrical lead lines 46 pass through the locator 50 along bores 50*a* and 50*b*.

The perforating gun housing 54 includes a reduced wall thickness area, or scallop 64, to which the shaped charge 48 is directed. The scallop 64 functions in a well known manner to provide a clean and well defined hole in the housing 54 upon detonation of the shaped charge 48, thereby preventing any outcropping or jagged edges which might tend to foul the perforating gun in a well.

The gun housing 54 is equipped with an access port 54*a* which receives a plug 66. The access port 54*a* may be threaded whereby the plug 66 is held to the housing by threaded engagement. Thus, the plug 66 may be inserted or removed relative to the access port 54*a* by means of a screwdriver fitted within a slot 66*a* in the top of the plug. An O-ring seal 68 is held between the flanged head of the plug 66 and an annular shoulder as part of the access port 54*a* to fluid-seal the interior of the housing 54 from the environment. As an alternative, the access port 54*a* may receive a compressible-type plug which is held in position within the access port by friction and also provides the necessary fluid-sealing.

The perforating gun 37 may be assembled to include the shaped charge 48, the PRIMACORD 38, and the electroexplosive device 10 without the initiator assembly 12, as shown in FIG. 2. This assembling may be conducted at any convenient location under ideal shop or laboratory conditions. The perforating gun 37 may then be safely shipped to a well site. Since the initiator assembly 12 provides the electrical-to-explosive interface, the remainder of the explosive train, including the receptor/donor assembly 18, the PRIMACORD 38, and the shaped charge 48, is incapable of inadvertent firing. Consequently, the perforating gun 37 without the initiator assembly 12 in place may be shipped, even along public highways, in compliance with current government regulations.

At the well site, the perforating gun 37 may be prepared for final use by the positioning of the initiator assembly 12 within the socket 14 and housing 16 as shown in FIG. 1. This may be accomplished by simply removing the plug 66 from the access port 54*a*, and inserting the initiator assembly 12 through the access port into the socket 14. A resilient cushion 70 in the form generally of a disc is then positioned, through the access port 54*a*, above the electroexplosive device 10, thereby covering the initiator assembly 12 and providing electrical insulation between the initiator assembly and the housing 54 and plug 66. The plug 66 is seated as shown in FIG. 2, and the perforating gun 37 is ready to be lowered into a well.

In FIG. 8 a downhole tool 72 including a multitude of perforating guns 37 is shown suspended in a well 73. The guns 37 are connected together electrically in a well known manner and with control equipment in a winch and control truck 74 at the surface. The electrical connections between the tool 72 and the truck 74 are by way of armored cable 76, which also provides the means by which the tool is lowered into the well and supported therein.

The well 73 is lined with casing 77 cemented in place. The tool 72 is lowered within the casing 77 to the level of an underground formation to be produced. The cable 76 passes over a sheave 78. Revolutions of the sheave 78 may be monitored as the tool 72 is lowered into the well as a means of determining the depth of the tool at any moment. When the shaped charge of a gun 37 is positioned at a level at which the well casing is to be perforated, an appropriate electrical signal is initiated by the control truck equipment to provide the necessary current through the leads 46 to heat the bridgewire 26 sufficiently to cause combustion of the pyrotechnic material 30.

Combustion of the pyrotechnic material 30 is accompanied by the production of hot gases which expand to fill the first housing chamber 16*a*, burning or disintegrating the cap 32 and passing through the passage 16*d* to the high level explosive material 36. Whether it is a gelatin capsule section or a brass dome, the cap 32 will yield under combustion of the pyrotechnic material 30.

The force of the combustion of the pyrotechnic explosive 30 acts to initiate the explosive 36. Initiation of the high order explosive material 36 in turn causes detonation of the PRIMACORD 38 which then causes detonation of the explosive of the shaped charge 48.

The detonation of the shaped charge 48 is accompanied by propulsion of a metallic slug or debris, depending on the nature of the shaped charge construction. The metallic missile from the shaped charge 48 proceeds through the housing 54 by breaking through the scallop 64, then perforates the well casing 77 and passes into the surrounding formation. Once the shaped charge 48 has been detonated, the hole produced at the scallop allows well fluid to pass into the interior of the housing 54 between the O-ring seals 60 and 62. However, the integrity of the O-ring seals 60 and 62 prevents fluid reaching the equipment at 56 and 58.

The transverse housing holes 16*e* make the binary electroexplosive device at 10 fluid-sensitive. Thus, if fluid leaks into the housing 54 in the vicinity of the electroexplosive device at 10 and the shaped charge 48 prior to detonation, the fluid is able to reach the explosive material 36 through the holes 16*e* to render this explosive material inert. Consequently, subsequent combustion of the pyrotechnic material 30 by application of a firing current to the initiator assembly 12 will fail to initiate the high order explosive material of the donor assembly 18. Thus, with fluid present in the housing about the PRIMACORD 38 and the shaped charge 48, neither the PRIMACORD 38 nor the shaped charge will be detonated. Otherwise, if the PRIMACORD 38 and shaped charge 48 were detonated with such fluid present in the housing, the fluid would tend to vaporize, causing high pressure within the housing which could cause the housing to expand and burst. In such case, the tool 72 might be irretrievably stuck within the well casing. Thus, the fluid-sensitive feature of the electroexplosive device 10 is a safety feature.

At the well site, the perforating gun may be safely armed by using a combination test and installation tool 80, illustrated in FIGS. 6 and 7. The test and installation tool 80 may be constructed of molded plastic or other suitable material generally in the shape of a wafer with arms 80*a* and 80*b* extending in opposite directions therefrom. The general shape of the test and installation tool 80 is not critical, and the particular design illustrated and described herein is suggested as one which provides easy hand manipulation for the procedures described hereinafter.

A light bulb 82 is mounted in a socket 83 and positioned within an aperture 80*c* of the tool 80. The socket 83 is connected to appropriate electrical lead wires 84 which extend along a passage 80*d* that runs the length of the arm 80*a*. The arm 80*a* ends in a generally oblong foot 80*e* which is of the same general shape as the initiator plug cap 22*b*. The wires 84 wrap around opposite arcuate ends of the foot 80*e* so that, when the foot 80*e* is inserted through the access port 54*a* into the socket hole 14*b*, electrical contact is made between the metallic strips 20 and the wires 84. Thus, the light bulb 82 is placed in the perforating gun firing circuit in the same location as would be the bridgewire 26 of the initiator assembly.

If the firing electrical system contains an electrical short or other defect so that sufficient power is available at the metallic strips 20 to provide a current at or above the threshold to fire the initiator explosive 30, the light bulb will emit light signaling to the operator that the electrical system is malfunctioning. The light bulb 82 is chosen to emit light only under the same current and voltage conditions which would cause the combustion of the initiator explosive 30. It should be noted that insertion of the initiator assembly 12 under such conditions of electrical malfunction would cause premature combustion of the pyrotechnic material 30 and attendant firing of the remainder of the explosive train, including the shaped charge 48. Thus, the use of the light bulb 82 provides a safety factor in arming the electroexplosive device 10. If, upon insertion of the foot 80*e* in the socket hole 14*b*, the light bulb does not emit light, the indication is that inadequate or no power is available at the metallic strips 20, and the electroexplosive device may be safely armed by positioning the initiator assembly 12 within the socket hole 14*b*. Thereafter, the explosive train may be fired by selective application of the appropriate power signal to the socket 14.

The other tool arm 80*b* contains a self-tapping screw 86 embedded therein, with the threaded shank of the screw protruding longitudinally outwardly beyond the end of the arm. A hole 22*c* is provided in the top of the initiator assembly plug 22. The initiator assembly 12 may thus be mounted on the test and installation tool 80 by threadedly engaging the screw 86 within the plug hole 22*c*. The plug 22 may be made of plastic or other material which may be tapped by the screw 86.

With the initiator assembly 12 mounted on the test and installation tool 80 as indicated in FIGS. 6 and 7, the electroexplosive device 10 may be readily armed by manipulating the tool 80 to pass the initiator assembly through the access port 54*a* and into the socket 14 and the housing 16. Once the initiator assembly 12 is seated as shown in FIGS. 1 and 5, the oblong shapes of the cap 22*b* and the socket hole 14*b* cooperate to prevent rotational motion of the initiator assembly relative to the socket and housing 16. As noted hereinbefore, the socket 14 and housing 16 may be of unitary construction, or the two may be bonded together to prevent rotational motion of the socket relative to the housing, which is mounted on the charge holder strip 42.

The test and installation tool 80 may be disengaged from the seated initiator assembly at 12 by simply rotating the tool 80 counterclockwise to unthread the screw 86 from the tapped plug hole 22*c*. With the electroexplosive device 10 now armed, the cushion 70 and the housing plug 66 may be positioned as shown in FIG. 2. The perforating gun 37 is then ready for operation.

It will be appreciated that the binary electroexplosive device of the present invention allows an otherwise-completed perforating gun, lacking only the initiator assembly to arm the electroexplosive device, to be transported over public highways in full compliance with current federal regulations. Furthermore, by using a binary blasting cap of the type described herein, an explosive train and firing electrical system may be assembled with all permanent electrical connections completed prior to the arming of the blasting cap itself. Thus, for example, there is no need to splice electrical wires within the perforating gun at the well site with the present invention. Since the initiator assembly 12 contains the electrical-to-explosive interface, removal of the initiator assembly from the explosive train prevents the explosive train from inadvertently firing due to an electrical system failure. Yet, the electrical system is completed and ready for firing upon the mere seating of the initiator assembly within the socket and housing as described.

Use of the binary electroexplosive device of the present invention also saves time since all of the operations required for preparation of the perforating gun having any skill requirements may be completed under the best possible conditions in a shop or laboratory. Only the arming of the electroexplosive device 10 by the insertion of the initiator assembly 12 through the access port 54*a* need be carried out at the job site, and this operation is facilitated by the test and installation tool 80.

While the electroexplosive device of the present invention is described and shown herein as applied to a well perforating gun, the binary blasting cap of the present invention may be employed with virtually any type of explosive train wherein the firing is to be initiated by means of an electrical signal. To this end, various components of the binary electroexplosive device may be varied in construction to accommodate the particular application. Thus, for example, the mounting of the electroexplosive device, which is accomplished herein by the sandwiching of the strip holder 42 between the receptor/donor assembly plug 34 and the housing 16, may be modified whereby either the housing or the receptor/donor assembly plug, or both, is held fixed by a bracket or other device. Also, as noted hereinbefore, the materials for construction of the various electroexplosive device components may be altered provided that the necessary electrical conductors are properly insulated, and no adverse chemical reactions are permitted between the explosive materials and the remaining electroexplosive device elements.

Additionally, the manner of construction of the test and installation tool 80, as well as its engagement with the initiator assembly plug 22 may be varied. For example, the tool and initiator assembly plug may be manufactured from a single piece of plastic or other material in generally the same configuration shown in FIGS. 6 and 7. In such case, the screw 86 is eliminated, and the tool and plug are constructed to be selectively broken apart. After seating of the initiator assembly 12 in the socket 14, the test and installation tool is simply broken away at the top of the initiator assembly plug.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Electroexplosive apparatus comprising:

(a) first explosive means including first explosive material and electrical firing means, including electrical lead means, for igniting said first explosive means in response to an electrical signal received by said firing means;

(b) second explosive means, including second explosive material;

(c) housing means for holding said second explosive means;

(d) socket means for selectively receiving said first explosive means, said socket means being so positioned relative to said second explosive means when said second explosive means is held by said housing means that said first explosive means is automatically positioned to permit initiation of said second explosive means by said first explosive means when said first explosive means is so received by said socket means;

(e) electrical conductor means, as part of said socket means, for receiving such electrical signal; and (f) whereby, when said first explosive means is so received by said socket means, said firing means is automatically electrically connected to said conductor means by said lead means so that said signal may be received by said firing means by means of said conductor means.

2. Apparatus as defined in claim 1 wherein said firing means further comprises bridgewire means connected across said lead means and positioned so that said bridgewire means may ignite said first explosive material when said signal is received by said firing means.

3. Apparatus as defined in claim 1 wherein:

(a) said first explosive means further comprises plug means for supporting said lead means;

(b) said socket means defines a hole for receiving said plug means when said socket means so receives said first explosive means; and (c) said plug means so received by said hole is thereby generally fixed against rotational movement relative to said socket means.

4. Apparatus as defined in claim 3 wherein said first explosive means further comprises sleeve means for cooperating with said plug means for containing said first explosive material.

5. Apparatus as defined in claim 4 wherein said first explosive means further comprises cap means for at least partially covering said first explosive material.

6. Apparatus as defined in claim 1 wherein said housing means comprises:

(a) first chamber means in which said first explosive material is generally positioned when said first explosive means is so received by said socket means;

(b) second chamber means in which said second explosive means is at least partially positioned when so held by said housing means; and (c) passage means for communicating explosive force from said first explosive means to said second explosive material.

7. Apparatus as defined in claim 1 wherein said first explosive material comprises pyrotechnic material.

8. Apparatus as defined in claim 1 wherein said first explosive means further comprises cap means for at least partially covering said first explosive material.

9. Apparatus as defined in claim 1 wherein said socket means is part of said housing means.

10. Apparatus as defined in claim 1 wherein said housing means includes one or more passages for communication of fluid from outside said housing means to the interior of said housing means whereby said second explosive material may be exposed to such fluid within said housing means.

11. A blasting cap comprising:

(a) housing means, including socket means;

(b) donor explosive means, including donor explosive material, for mounting at a first location relative to said housing means, said first location being generally distal said socket means;

(c) electrical conductor means, as part of said socket means; and (d) initiator assembly means selectively receivable by said socket means and including initiator explosive means and electrical firing means wherein, when said initiator assembly means is received by said socket means, said electrical firing means are automatically in electrical contact with said conductor means and said initiator explosive means is automatically positioned at a second location relative to said housing means such that ignition of said initiator explosive means may cause initiation of said donor explosive means.

12. A blasting cap as defined in claim 11 wherein said firing means comprises:

(a) electrical lead means which make electrical contact with said conductor means when said initiator assembly means is so received by said socket means; and (b) bridgewire means connected across said lead means and positioned for firing said initiator explosive means in response to a predetermined electrical signal applied to said conductor means.

13. A blasting cap as defined in claim 12 wherein:

(a) said initiator assembly means further comprises plug means for supporting said lead means;

(b) said socket means defines a hole for receiving said plug means when said socket means so receives said initiator assembly means; and (c) said plug means so received by said hole in thereby generally fixed against rotational movement relative to said socket means.

14. A blasting cap as defined in claim 13 wherein said initiator assembly means further comprises sleeve means for cooperating with said plug means for containing said initiator explosive means.

15. A blasting cap as defined in claim 13 wherein said initiator assembly means further comprises cap means for at least partially covering said initiator explosive means.

16. A blasting cap as defined in claim 11 wherein said housing means further comprises:

(a) first chamber means in which said initiator explosive means is generally positioned when said initiator assembly means is so received by said socket means;

(b) second chamber means by which said donor explosive means is so mounted; and (c) passage means for communicating explosive force from said initiator assembly means to said donor explosive means.

17. A blasting cap as defined in claim 14 wherein said initiator explosive means comprises pyrotechnic material.

18. A blasting cap as defined in claim 11 wherein said housing means includes one or more passages for communication of fluid from outside said housing means to the interior of said housing means whereby said donor explosive material may be exposed to such fluid within said housing means.

19. A perforating gun assembly comprising:

(a) a gun housing;

(b) a binary blasting cap, including blasting cap housing means and socket means, for mounting within said gun housing;

(c) shaped charge means, including shaped charge explosive means, for mounting within said gun housing and for detonating in response to the firing of said blasting cap;

(d) donor explosive means, as part of said blasting cap for mounting on said blasting cap housing means;

(e) electrical conductor means for receiving an electrical firing signal and conducting said signal to said blasting cap;

(f) electrical terminal means as part of said socket means and to which said signal may be conducted by said conductor means;

(g) initiator assembly means, as part of said blasting cap, which may be selectively seated in said socket means;

(h) initiator explosive material, as part of said initiator assembly means, which is automatically positioned to permit initiation of said donor explosive means when said initiator assembly means is so seated in said socket means; and (i) electrical firing means, as part of said initiator assembly means, which, when said initiator assembly means is so seated in said socket means, automatically makes electrical contact with, and may receive said signal from, said terminal means, for igniting said initiator explosive material.

20. A perforating gun assembly as defined in claim 19 further comprising intermediate explosive means positioned to be ignited by said donor explosive means and to detonate said shaped charge means.

21. A perforating gun assembly as defined in claim 20 further comprising bracket means whereby said intermediate explosive means is held in the vicinity of said donor explosive means.

22. A perforating gun assembly as defined in claim 19 wherein:

(a) said donor explosive means includes donor plug means containing donor explosive material; and (b) said donor plug means is received and held by said blasting cap housing means.

23. A perforating gun assembly as defined in claim 19 further comprising charge holder strip means for supporting said blasting cap and said shaped charge means.

24. A perforating gun assembly as defined in claim 19 wherein:

(a) said initiator assembly means further comprises initiator plug means, for supporting said electrical firing means, receivable by said socket means whereby said initiator assembly means is so seated in said socket means;

(b) said initiator plug means so received by said socket means is held fixed thereby against rotational movement relative to said socket means; and (c) said firing means includes electrical lead means, which electrically connect to said terminal means when said initiator plug means is so received by said socket means, and bridgewire means connected across said lead means and positioned to ignite said initiator explosive material in response to said signal received by said terminal means so connected to said lead means.

25. A perforating gun assembly as defined in claim 24 wherein said initiator assembly means further comprises sleeve means for cooperating with said initiator plug means for containing said initiator explosive material.

26. A perforating gun assembly as defined in claim 24 wherein said initiator assembly means further comprises cap means for at least partially covering said initiator explosive material.

27. A perforating gun assembly as defined in claim 24 further comprising:

(a) test means for receiving by said socket means when said initiator assembly means is not so seated in said socket means, said test means including test lead means which automatically electrically connect with said terminal means when said test means is so received by said socket means, and indicator means responsive to electrical signals received by said test lead means;

(b) access means in said gun housing whereby said test means may extend into said gun housing and be so received by said socket means therein; and (c) housing plug means for selectively closing said access means.

28. A perforating gun assembly as defined in claim 24 further comprising:

(a) access means in said gun housing whereby said initiator assembly means may be passed into said gun housing and so seated in said socket means;

(b) housing plug means for selectively closing said access means; and (c) installation tool means for selectively releaseably engaging and supporting said initiator assembly means whereby said initiator assembly means may be passed into said gun housing through said housing access means and so received by said socket means whereupon said installation tool means may be disengaged from said initiator assembly means.

29. A perforating gun assembly as defined in claim 19 wherein said initiator explosive material comprises pyrotechnic material.

30. A perforating gun assembly as defined in claim 19 further comprising:

(a) test means for receiving by said socket means when said initiator assembly means is not so seated in said socket means, said test means including test lead means which automatically electrically connect with said terminal means when said test means is so received by said socket means, and indicator means responsive to electrical signals received by said test lead means;

(b) access means in said gun housing whereby said test means may extend into said gun housing and be so received by said socket means therein; and (c) housing plug means for selectively closing said access means.

31. A perforating gun assembly as defined in claim 19 further comprising:

(a) access means in said gun housing whereby said initiator assembly means may be passed into said gun housing and so seated in said socket means;

(b) housing plug means for selectively closing said access means; and (c) installation tool means for selectively releaseably engaging and supporting said initiator assembly means whereby said initiator assembly means may be passed into said gun housing through said housing access means and so received by said socket means whereupon said installation tool means may be disengaged from said initiator assembly means.

32. A perforating gun assembly as defined in claim 19 wherein said blasting cap housing means comprises:

(a) first chamber means in which said initiator explosive material is generally positioned when said initiator assembly means is so seated in said socket means;

(b) second chamber means in which said donor explosive means is so mounted on said blasting cap housing means; and (c) passage means for communicating explosive force from said initiator explosive material to said donor explosive means.

33. A perforating gun assembly as defined in claim 19 wherein said blasting cap housing means includes one or more passages for communication of fluid from outside said blasting cap housing means to the interior of said blasting cap housing means whereby said donor explosive means may be exposed to such fluid with said blasting cap housing means.

34. A method of assembling an explosive train comprising the steps of:

(a) positioning a donor explosive of a binary blasting cap relative to a second explosive such that the second explosive may be detonated by explosion of the donor explosive;

(b) providing a socket, as part of the binary blasting cap, with electrical conductors by which an electrical firing signal may be received by the blasting cap; and (c) selectively arming the binary blasting cap by selectively seating, in the socket, an initiator assembly including an electrical firing mechanism and an initiator explosive, whereby the step of so seating the initiator assembly makes electrical contact between the firing mechanism and the socket conductors, and positions the initiator explosive to permit initiation of the donor explosive.

35. A method as defined in claim 34 further comprising the step of placing an electrically-responsive test tool in electrical contact with the socket conductors before the initiator assembly is seated in the socket to test for the presence of an electrical signal.

36. A method of arming a perforating gun comprising the steps of passing an initiator assembly, including an initiator explosive and an electrically-responsive firing mechanism for igniting the initiator explosive, into the housing of the gun, and seating the initiator assembly in a socket equipped with electrical terminals for conducting an electrical firing signal, whereby the socket terminals are automatically electrically connected to electrical leads of the initiator assembly firing mechanism, and the initiator explosive is automatically positioned to permit initiation of a donor explosive for detonating the remainder of the perforating gun explosives.

37. A method as defined in claim 36 wherein the initiator assembly is so passed into the housing of the gun through an access port in the housing.

38. A method as defined in claim 37 or, in the alternative, as defined in claim 36 wherein, before the initiator assembly is so seated in the socket, a test tool, including an electrically-responsive indicator and test lead lines for conducting electricity to the indicator, is seated in the socket whereby the test lead lines are automatically electrically connected to the socket terminals.

39. A method as defined in claim 37 wherein the initiator assembly is so passed through the access port and so seated in the socket while engaged with an installation tool which, after the initiator assembly is seated in the socket, is disengaged from the initiator assembly and withdrawn from the access port.

* * * * *

UNITED STATES PATENT AND TRADEMARK OFFICE

CERTIFICATE OF CORRECTION

PATENT NO. : 4,291,623

DATED : September 29, 1981

INVENTOR(S) : Ralph L. Robinson, David D. Parrish

It is certified that error appears in the above—identified patent and that said Letters Patent is hereby corrected as shown below:

In Column 13, line 52, delete "in" and insert therefor --is--.

In Column 14, line 6, delete "14" and insert therefor --11--.

Signed and Sealed this

*Eighteenth* Day of *December 1984*

[SEAL]

*Attest:*

GERALD J. MOSSINGHOFF

*Attesting Officer*

*Commissioner of Patents and Trademarks*